US007137904B2

(12) United States Patent
Huang

(10) Patent No.: US 7,137,904 B2
(45) **Date of Patent: *Nov. 21, 2006**

(54) SPIRAL WRAP GOLF CLUB GRIP

(76) Inventor: Ben Huang, 19472 Woodlands La., Huntington Beach, CA (US) 92648

( * ) Notice: Subject to any disclaimer, the term of this patent is extended or adjusted under 35 U.S.C. 154(b) by 0 days.

This patent is subject to a terminal disclaimer.

(21) Appl. No.: 10/167,216

(22) Filed: Jun. 11, 2002

(65) Prior Publication Data

US 2003/0228930 A1 Dec. 11, 2003

(51) Int. Cl.
*A63B 53/14* (2006.01)

(52) U.S. Cl. ..... 473/301; 473/549

(58) Field of Classification Search ..... 473/300–303, 473/549, 568; 16/421, DIG. 12, DIG. 24, 16/DIG. 25; 280/821; 81/492, 489; 74/551.9; D08/DIG. 6, DIG. 756; D21/756
See application file for complete search history.

(56) References Cited

U.S. PATENT DOCUMENTS

| | | | |
|---|---|---|---|
| 571,025 | A | 11/1896 | Spamer |
| 979,266 | A | 12/1910 | Dean |
| 1,008,604 | A | 11/1911 | Lake |
| 1,017,565 | A | 2/1912 | Lard |
| 1,139,843 | A | 5/1915 | Brown |
| 1,345,505 | A | 7/1920 | Persons |
| 1,435,088 | A | 11/1922 | Smith |
| 1,522,635 | A | 1/1925 | Kraeuter |
| 1,528,190 | A | 3/1925 | Howe |
| 1,617,972 | A | 2/1927 | Wallace |
| 1,890,037 | A | 12/1932 | Johnson |
| 1,943,399 | A | 1/1934 | Smith |
| 2,000,295 | A | 5/1935 | Oldham |
| 2,086,062 | A | 7/1937 | Bray |
| 2,103,889 | A | 12/1937 | Brisick |
| 2,149,911 | A | 3/1939 | East |
| 2,221,421 | A | 11/1940 | Curry |
| 2,225,839 | A | 12/1940 | Moore |
| 2,449,575 | A | 9/1948 | Wilhelm |
| 2,523,637 | A | 9/1950 | Stanfield et al. |
| 2,690,338 | A | 9/1954 | Brocke |
| 2,772,090 | A | 11/1956 | Brandon |
| 2,984,486 | A | 5/1961 | Jones |
| 3,087,729 | A | 4/1963 | Sullivan |
| 3,095,198 | A | 6/1963 | Gasche |
| 3,157,723 | A | 11/1964 | Hochberg |
| 3,311,375 | A | 3/1967 | Onions |

(Continued)

FOREIGN PATENT DOCUMENTS

EP 1 371 397 12/2003

OTHER PUBLICATIONS

European Search Report, European Application No. EP 04 25 7967, 4 pages- cites: US 2004/185958; EP 1 371 397; US 2,225,839; US 6,666,777; US 5,839,983; US 5,577,722; and US 979,266.

(Continued)

*Primary Examiner*—Stephen Blau
(74) *Attorney, Agent, or Firm*—Knobbe Martens Olson & Bear LLP

(57) ABSTRACT

A golf club grip that includes a resilient strip spirally wrapped about an underlisting sleeve having a cap and a nipple. The underside of the cap is made with a downwardly facing circumferential slot that snugly receives the upper edge of the strip. The nipple is formed with an upwardly facing groove that snugly receives the lower portion of the strip.

26 Claims, 5 Drawing Sheets

U.S. PATENT DOCUMENTS 3,366,384 A 1/1968 Lamkin et al.
3,606,325 A 9/1971 Lamkin et al.
4,015,851 A 4/1977 Pennell
4,052,061 A 10/1977 Stewart
4,133,529 A 1/1979 Gambino
4,137,360 A 1/1979 Reischl
4,347,280 A 8/1982 Lau et al.
4,358,499 A 11/1982 Hill
4,448,922 A 5/1984 McCartney
4,651,991 A 3/1987 McDuff
4,662,415 A 5/1987 Proutt
4,765,856 A 8/1988 Doubt
4,878,667 A 11/1989 Tosti
4,941,232 A 7/1990 Decker et al.
5,055,340 A * 10/1991 Matsumura et al. ..... 428/172
5,118,107 A 6/1992 Bucher
5,123,646 A 6/1992 Overby et al.
5,127,650 A 7/1992 Schneller
5,469,601 A 11/1995 Jackson
5,511,445 A 4/1996 Hildebrandt
5,570,884 A 11/1996 Carps
5,571,050 A 11/1996 Huang
5,577,722 A 11/1996 Glassberg
5,584,482 A 12/1996 Huang
5,611,533 A 3/1997 Williams
5,624,116 A 4/1997 Yeh
5,626,527 A 5/1997 Eberlein
5,645,501 A 7/1997 Huang
5,671,923 A 9/1997 Huang
5,695,418 A 12/1997 Huang
5,730,669 A 3/1998 Huang
5,772,524 A 6/1998 Huang
5,781,963 A 7/1998 Maru et al.
5,797,813 A 8/1998 Huang
5,813,921 A 9/1998 Huang
5,816,933 A 10/1998 Huang
5,839,983 A 11/1998 Kramer
5,851,632 A 12/1998 Chen et al.
5,857,929 A * 1/1999 Huang ..... 473/549
5,867,868 A 2/1999 Ward
5,890,260 A 4/1999 Gaunt
5,890,972 A 4/1999 Huang
5,895,329 A 4/1999 Huang
5,924,941 A * 7/1999 Hagey ..... 473/551
6,036,607 A 3/2000 Finegan
6,197,392 B1 3/2001 Jones
6,226,836 B1 5/2001 Yasui
6,244,975 B1 6/2001 Huang
6,361,450 B1 3/2002 Huang
6,386,989 B1 5/2002 Huang
6,449,803 B1 * 9/2002 McConchie ..... 16/431
6,503,153 B1 1/2003 Wang
6,506,128 B1 1/2003 Bloom, Jr.
6,551,198 B1 4/2003 Huang
6,558,270 B1 5/2003 Kwitek
6,627,023 B1 9/2003 Gleichenhagen et al.
6,627,027 B1 9/2003 Huang
6,629,901 B1 * 10/2003 Huang ..... 473/549
6,656,057 B1 12/2003 Manual et al.
6,663,500 B1 12/2003 Huang
6,666,777 B1 12/2003 Lamkin et al.
6,676,534 B1 1/2004 Huang
2002/0142858 A1 10/2002 Chen
2002/0142900 A1 10/2002 Wang
2002/0173371 A1 11/2002 Lamkin et al.
2003/0040384 A1 2/2003 Falone et al.
2003/0045370 A1 3/2003 Jaw
2003/0148836 A1 8/2003 Falone et al.
2003/0150081 A1 8/2003 Wang
2003/0216192 A1 11/2003 Chu
2004/0029645 A1 2/2004 Chen
2004/0185958 A1 9/2004 Huang

OTHER PUBLICATIONS

Partial European Search Report, App. No. EP 03 25 5917, 2 pages-cites: 5,671,923; 4,765,856; US 2002/173371; US 2003/040384; and 5,571,050.
U.S. Appl. No. 10/392,480, filed Mar. 18, 2003, now U.S. Patent No. 6,857,971, issued Feb. 22, 2005.
U.S. Appl. No. 10/167,216, filed Jun. 11, 2002, pending.
U.S. Appl. No. 10/348,389, filed Jan. 21, 2003, now U.S. Patent No. 6,733,401, issued May 11, 2004.
U.S. Appl. No. 10/746,764, filed Dec. 23, 2003 now U.S. Patent No. 6,843,732, issued Jan. 18, 2005.
U.S. Appl. No. 10/608,598, filed Jun. 27, 2003, pending.
U.S. Appl. No. 10/785,379, filed Feb. 24, 2004, pending.
U.S. Appl. No. 10/827,095, filed Apr. 19, 2004, pending.
U.S. Appl. No. 10/875,035, filed Jun. 23, 2004, pending.
U.S. Appl. No. 11/029,328, filed Jan. 5, 2005, pending.
U.S. Appl. No. 11/062,046, filed Feb. 18, 2005, pending.
U.S. Appl. No. 11/131,832, filed May 18, 2005, pending.
U.S. Appl. No. 11/172,770, filed Jul. 1, 2005, pending.
Docket Sheet for U.S. District Court- Central District of California (Southern Division- Santa Ana) Civil Docket for Case #: 8:05-CV-00168 CJC (RNBx) entitled *Winn, Inc., et al.* v *Karakal Far East Ltd., et al.*
Memorandum of Points and Authorities in Support of Plaintiff's Motion for A Preliminary Injunction Filed Feb. 28, 2005.
Declaration of Ben Huang in Support of Plaintiff's Motion for A Preliminary Injunction Filed Feb. 28, 2005.
Declaration of Charles A. Garris in Support of Paintiffs' Motion for Preliminary Injunction Filed Feb. 28, 2005.
U.S. Appl. No. 11/412,196, filed Apr. 25, 2006, pending.
U.S. Appl. No. 11/416,364, filed May 1, 2006, pending.
U.S. Appl. No. 11/413,411, filed Apr. 28, 2006, pending.
U.S. Appl. No. 11/438,808, filed May 22, 2006, pending.
U.S. Appl. No. 11/417,643, filed May 3, 2006, pending.
U.S. Appl. No. 11/417,696, filed May 3, 2006, pending.
U.S. Appl. No. 11/417,623, filed May 3, 2006, pending.
U.S. Appl. No. 11/417,655, filed May 3, 2006, pending.
U.S. Appl. No. 11/417,401, filed May 3, 2006, pending.

* cited by examiner

FIG. 4
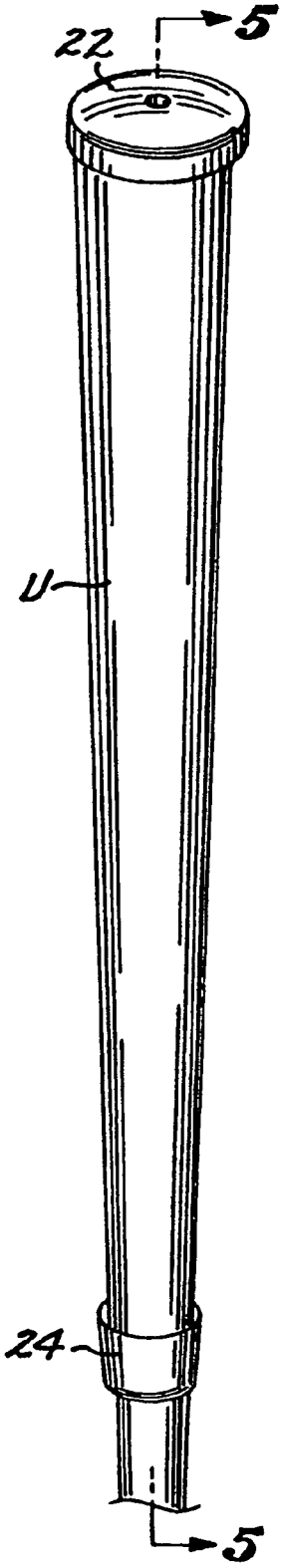
FIG. 5
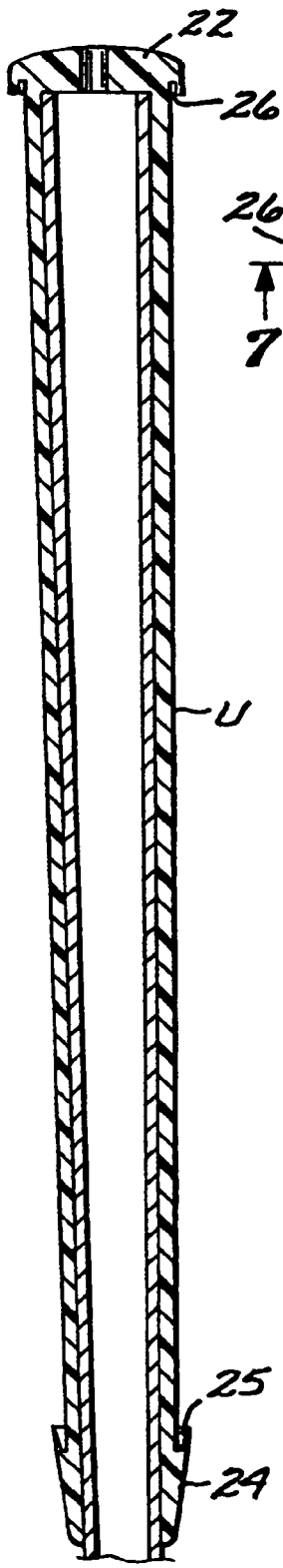
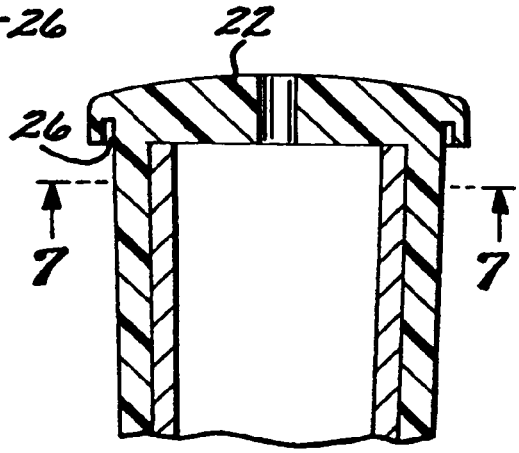
FIG. 6
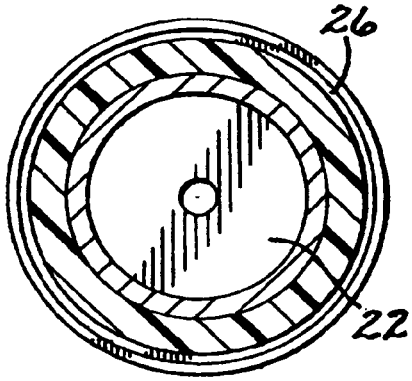
FIG. 7

SPIRAL WRAP GOLF CLUB GRIP

BACKGROUND OF THE INVENTION

The present invention relates to an improved grip assembly for golf clubs and other sporting equipment employing handles subject to shock when such devices are impacted.

It is well known that the shock generated by impact between a golf club and a golf ball can adversely affect muscle tissue and arm joints. The energy generated by such impact is usually of high frequency and short duration with rapid decay and which is often known as "impact shock." Tight grasping of a golf club grip to keep it from slipping in a user's hands contributes to such impact shock.

The Applicant has previously developed resilient grips which successfully reduce or even eliminate impact shock to the muscle and arm joint of the users of golf clubs. See for example U.S. Pat. No. 5,797,813, granted to applicant Aug. 25, 1998. Such earlier grips utilize a polyurethane layer bonded to a felt layer to define a resilient strip, which is spirally wrapped around an underlisting sleeve, with such underlisting sleeve being slipped over the handle portion of a golf club shaft.

A problem encountered with such grips is the tendency of the spirally-wrapped resilient strip to unravel from the golf club handle when a golf club is removed form and inserted into a golf bag. This problem has existed since at least 1923 as evidenced by Howe U.S. Pat. No. 1,528,190 wherein the inventor stated:

> "After using a club, the golfer often throws his club violently into his bag; in doing so the handle end is of course within the bag.
>
> When the club is thrown into the bag in this way, the end of the handle rubs along the inside of the bag and frequently results in stripping the end of the leather beyond the cord wrapping. Then the cord wrapping will become displaced or broken and it will be necessary to repair the handle."

My U.S. Pat. No. 6,386,989 discloses a golf club grip wherein the lower end of the resilient strip is restrained from unraveling from the underlisting sleeve by forming the upper portion of the nipple of the sleeve with a circumferential groove which receives the lowermost edge of the strip, after which an outer peripheral lip defined by the groove is folded upwardly over such lower edge. The lip snugly encompasses the strip's lower edge and retains the lower edge against unraveling from the sleeve and hence the handle of the golf club during play, as well as when a golf club is inserted into and removed from a golf bag.

SUMMARY OF THE INVENTION

A golf club grip assembly comprising a resilient underlisting sleeve formed at its upper end with a cap and at its lower end with a nipple, a flange cooperating to define a downwardly facing circumferential slot formed on the underside of the cap when such cap is made, the cap configured and constructed such that the flange is unable to be completely flipped in a reverse direction, and an upwardly facing groove formed in the upper portion of the nipple, the outer portion of the groove being defined by a flexible circumferential lip, with the lip being expandable outwardly. The assembly further comprising a resilient strip spirally wrapped about and adhered to the underlisting sleeve between the lower portion of the cap and the upper portion of the nipple with the upper edge of the resilient strip being inserted into the circumferential cap slot so as to be firmly locked therein, and the circumferential nipple lip being expandable outwardly to receive the lower end of the resilient strip within the groove, with the cap slot and nipple groove cooperating to thereby restrain the entire length of the strip from unraveling from the underlisting sleeve.

These and other features and advantages of the present invention will become apparent from the following detailed description of a preferred embodiment which, taken in conjunction with the accompanying drawings, illustrates by way of example the principles of the invention.

BRIEF DESCRIPTION OF THE DRAWINGS

FIG. 4 is a side view of an underlisting sleeve utilized in a spiral-wrap golf club grip embodying the present invention;

FIG. 5 is a vertical sectional view taken in enlarged scale along line 5—5 of FIG. 4;

FIG. 6 is a cross-sectional view showing the upper portion of the underlisting sleeve of FIG. 5;

FIG. 7 is a horizontal view taken along line 7—7 of FIG. 6;

DETAILED DESCRIPTION OF THE PREFERRED EMBODIMENTS

Figure 1:
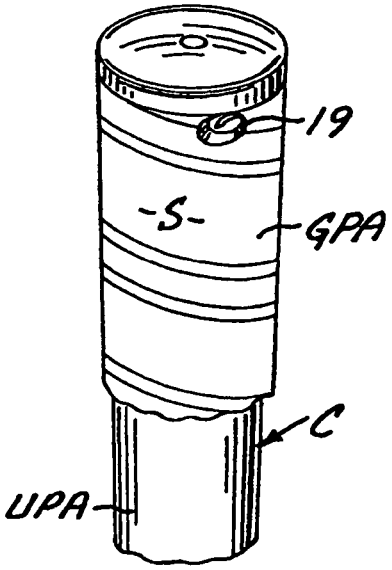
FIG. 1 PRIOR ART
FIG. 1 is a broken perspective view showing the upper portion of a spirally-wrapped prior art golf club grip starting to unravel from the handle of a golf club.
Figure 2:
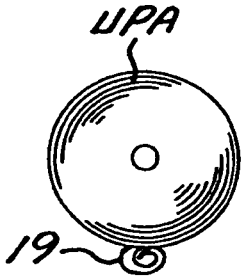
FIG. 2 PRIOR ART
FIG. 2 is a top plan view of the golf club grip shown in FIG. 1.
Figure 3:
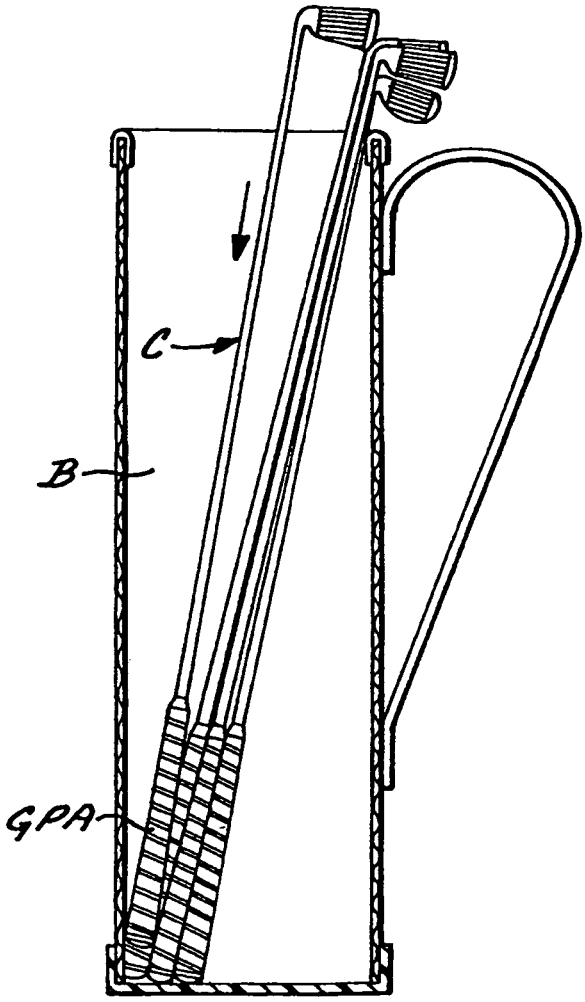
FIG. 3 PRIOR ART
FIG. 3 is a cut-away side view showing a golf club provided with a prior art golf club grip being inserted into a golf bag resulting in the unraveling of FIGS. 1 and 2.
Figure 8:
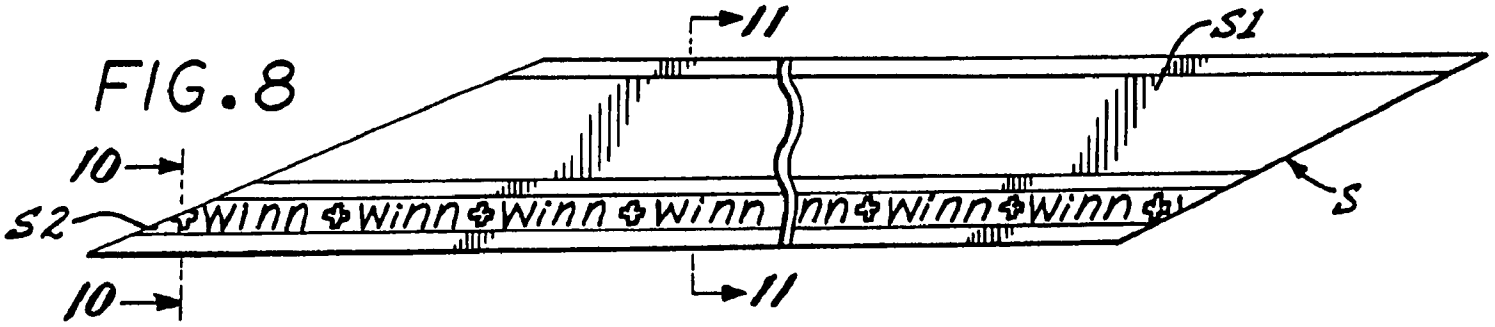
FIG. 8 is a broken top view of a resilient strip of a grip embodying the present invention.

Referring to the drawings, FIGS. 1, 2 and 3 show a golf club C having a shaft 20 upon the handle H of which is installed a prior art resilient grip GPA. Grip GPA includes a polyurethane-felt strip S which is spirally wrapped about a resilient underlisting UPA similar to that shown and described in my U.S. Pat. No. 6,386,989. A plurality of such prior art golf club grips are inserted into and removed form a conventional golf bag B during play. As noted in FIG. 3, during such insertion and removal, the grips GPA of the golf clubs have sliding contact with other golf club grips and the sides of the golf bag B. Such contact causes the upper end of the resilient strips to unravel from the golf club handles. In FIGS. 1 and 2 there is shown the manner in which unraveling of the upper end 19 of resilient strip S takes place. Such unraveling not only detracts from the appearance of the grip, but is also distracting to a golfer when he takes a swing of the club because of the rough feel of the unraveled portion of the strip.

Referring now to FIGS. 4–12, there are shown the components of a preferred form of golf club grip G embodying the present invention. Such grip includes resilient underlistiug sleeve U, similar to that described in my U.S. Pat. No. 6,386,989. Sleeve U includes an integral cap 22 at its upper end, while the lower end of the sleeve is formed with an integral nipple 24. The upper portion of nipple 24 is formed with a circumferential groove 25 for a purpose described hereinafter. It should be particularly noted that the underside of cap 22 is formed with a circumferentially extending slot 26 defined by a flange cooperating with the sleeve U, which receives the upper end of the resilient sleeve S of FIGS. 8–11 in a manner to be described hereinafter. A flange cooperates to define a downwardly facing circumferential slot formed on the underside of the cap when such a cap is made. The cap is configured and constructed such that the flange is unable to be completely flipped in a reverse direction.

More particularly, strip S is fabricated from first and second individual segments S1 and S2 of different widths, with segment S1 preferably being wider than segment S2. Segment S1 includes a bottom backing layer, 30 (preferably of felt) having an inner or bottom surface which is adhered to the aforedescribed underlisting sleeve U. Segment S1 also includes a top layer of a suitable resilient plastic material, such as a smooth closed-pore polyurethane layer, generally designated 34, with the polyurethane layer being bonded to the upper surface of its adjacent bottom layer. The segment S1 may be formed with vertical air-passing perforations (not shown) such as described in my U.S. Pat. No. 5,645,501 issued Jul. 8, 1997. Segment S2 is similar in construction to segment S1 and includes an open-pored bottom backing layer, generally designated 36 (preferably of felt), having an inner or bottom surface which is adhered to underlisting sleeve U. Segment S2 also includes a top layer 40 of a suitable resilient plastic material such as polyurethane layer, with the polyurethane layer being bonded to the upper surface of its adjacent backing layer 36. The polyurethane layer of each strip segment S1 and S2 may be formed in a conventional manner by coating a felt strip with one or more solutions of polyurethane (e.g., polyester or polyether) dissolved in a dimethyl formamide (DMF), immersing the coated strip in water baths to displace the DMF and cause the urethane to coagulate, and finally driving off the water by the application of pressure and heat. In this manner, pores are formed in the polyurethane layer, while the underside of the polyurethane layer is bonded to the upper surface of the felt layer. The thickness of the polyurethane layer is preferably about 0.2–1.40 millimeters and the thickness of the felt layer is about 0.7–1.90 millimeters.

The felt layers 30 and 36 serve as backing layers for the polyurethane layer 34 and polyurethane coating 40 so as to provide strength for the polyurethane. The felt also cooperates with the polyurethane to assist in cushioning the shocks applied to a grip when a golf ball is struck by a golf club. It should be noted that other materials may be substituted for the felt as a backing layer to provide strength for the polyurethane and to cushion shocks, e.g., a synthetic plastic such as an ethylene-vinyl acetate copolymer, commonly known as EVA. The felt may be fabricated of conventional suitable materials such as nylon, cotton, polyester or the like.

The entire underside of backing layer 30 of segment S1 is provided with an adhesive 54 initially covered in a conventional manner by a peel-away tape 56. Peel-away tape 56 includes a thin band 56B (not shown) which can be pulled off the main body of tape 56 to expose adhesive 54 disposed on one edge of segment S1, while the tapes' main body remains on the adhesive covering the remainder of the segment S1.

Figure 9:
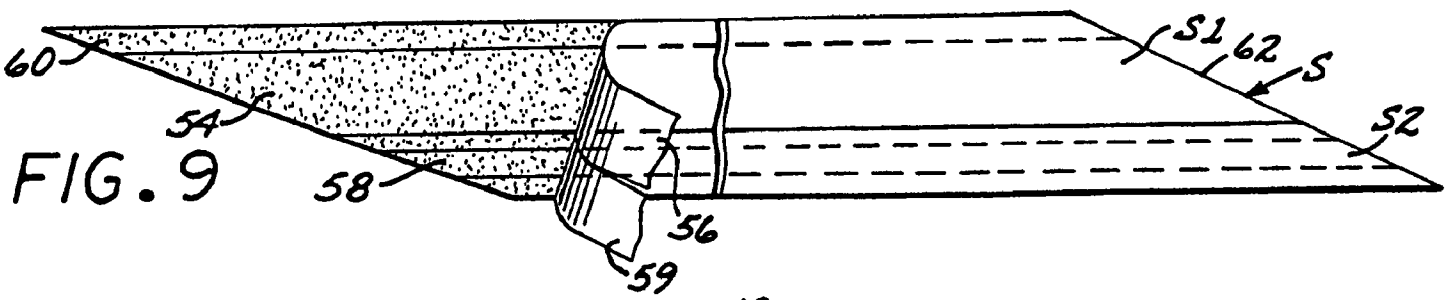
FIG. 9 is a bottom view showing the underside of the grip of FIG. 8.
Figure 10:
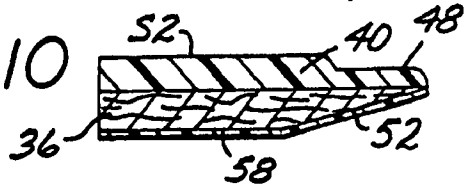
FIG. 10 is a vertical sectional view taken in enlarged scale along line 10—10 of FIG. 8.
Figure 11:
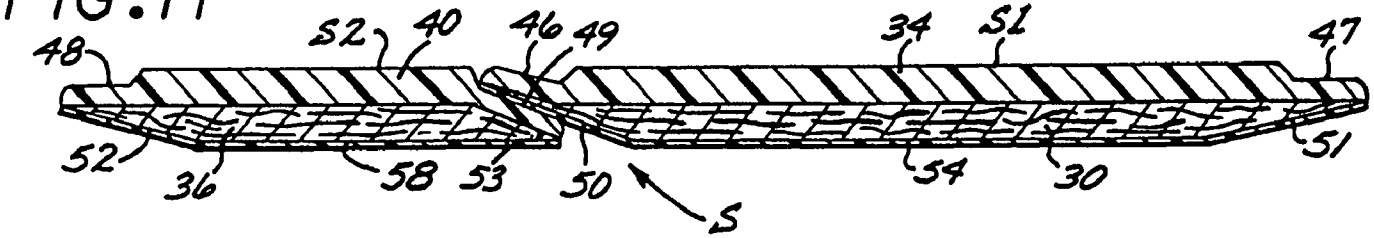
FIG. 11 is a vertical sectional view taken in enlarged scale along line 11—11 of FIG. 8.
Figure 12:
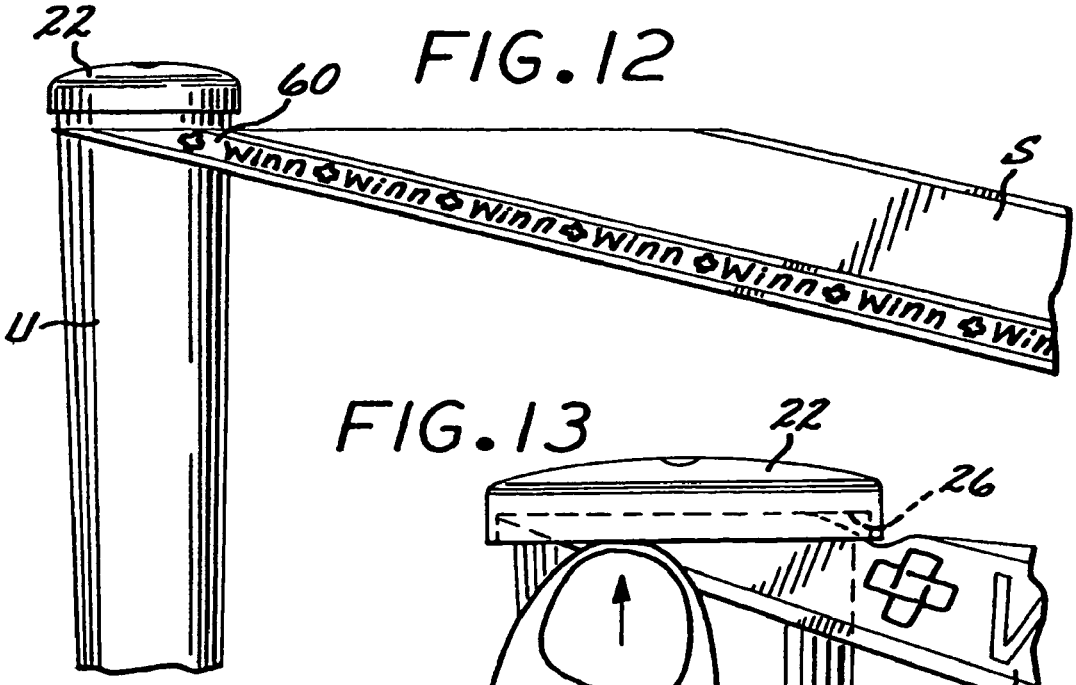
FIG. 12 is a broken side elevational view showing the strip of FIGS. 8–10 about to be spirally-wrapped about the underlisting sleeve of FIGS. 4–7.

Referring now to FIG. 11, the side edges of the polyurethane layer 34 of segment S1 are formed with sidewardly and outwardly extending reinforcement side edges 46 and 47. The side edges of the polyurethane layer 40 of segment S2 are also formed with sidewardly and outwardly extending reinforcement side edges 48 and 49. In FIG. 11, the side edges of the felt layer 30 of segment S1 have been skived to form outwardly and upwardly slanted side edges 50 and 51. Similarly, the side edges of felt layer of segment S2 have been skived to form outwardly and upwardly slanted side edges 52 and 53. The underside of segment S2 is covered with an adhesive 58 initially covered by a peel-away tape 59 (FIG. 9). To combine segments S1 and S2 into composite strip 5, reinforced side edge 49 of segment S2 is then placed underneath skived side edge 50 of segment S1 as shown in FIG. 11 and pressed onto segment S1. The strip S is then cut on both ends to provide the leading edge and trailing edges 60 and 62.

It should be particularly noted that the upper area of polyurethane layer 40 of segment S2 inwardly of the recessed side edges may be embossed with depressed indicia I, such as the name of the manufacturer of the golf club grip. Such embossing serves not only as a decorative enhancement of the golf club grip, but additionally, the embossing process densifies the polyurethane layer 40 so as to reduce stretching of the second segment and thereby increase the hoop strength of the strip S. It is also desirable to mold the polyurethane layer 34 of segment S1 in a first color while polyurethane layer 40 of segment S2 is molded in a second color that contrasts with the first color. With this arrangement, a multicolored grip having a pleasing appearance will result when the strip S is spirally wrapped about an underlisting sleeve.

Figure 13:
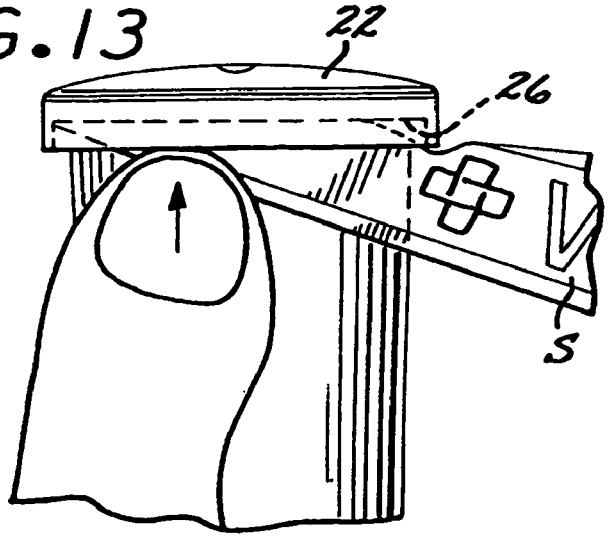
FIG. 13 is a broken side elevational view taken in enlarged scale showing the leading edge of the resilient strip being manually forced into an upwardly extending circumferential slot formed in the underside of the cap of said underlisting sleeve.
Figure 14:
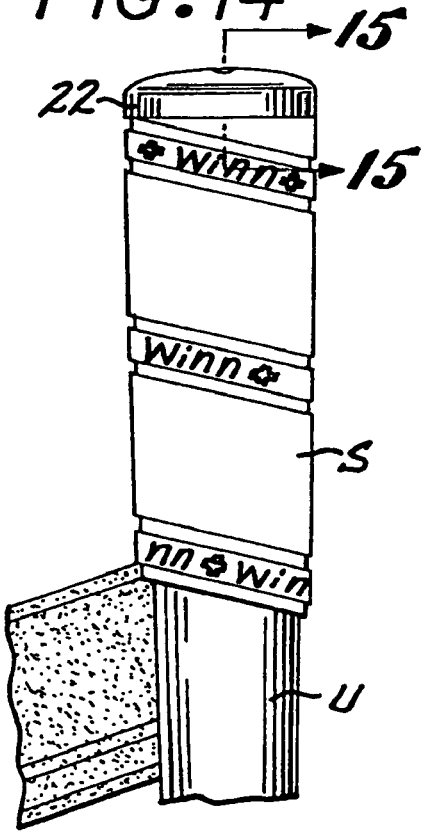
FIG. 14 is broken side elevational view showing the resilient strip being spirally-wrapped about the underlisting sleeve.
Figure 15:
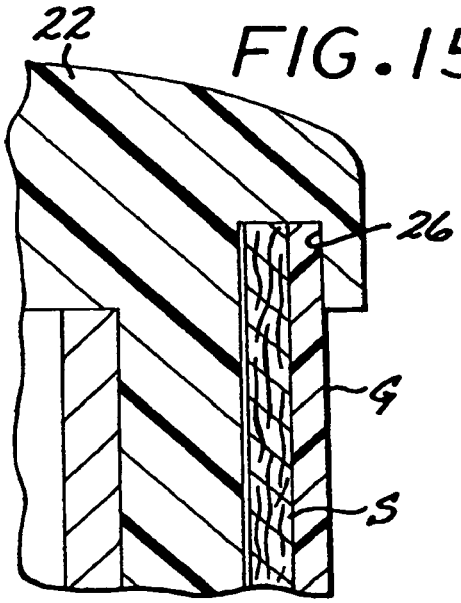
FIG. 15 is a broken vertical sectional view taken in enlarged scale along line 15—15 of FIG. 14.
Figure 16:
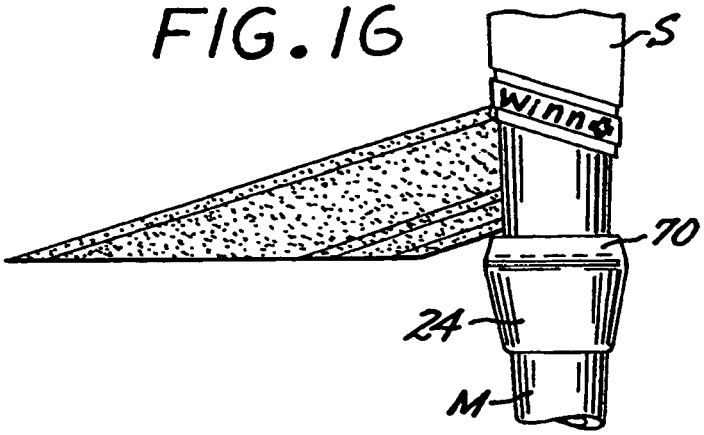
FIGS. 16, 17 and 18 are broken side elevational views showing the lower portion of the resilient sleeve being spirally wrapped around and secured to the lower portion of the underlisting sleeve.
Figure 17:
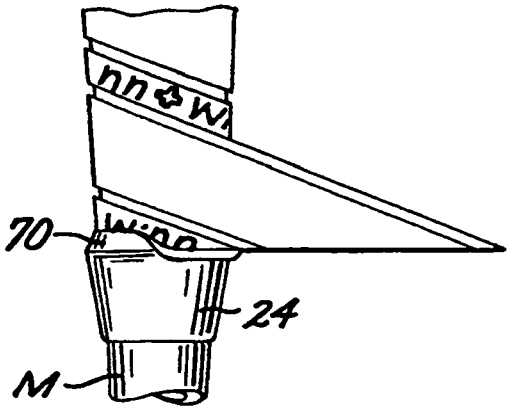
Figure 18:
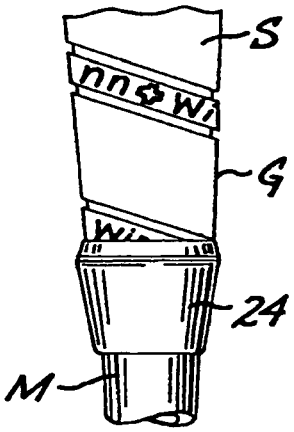
Figure 19:
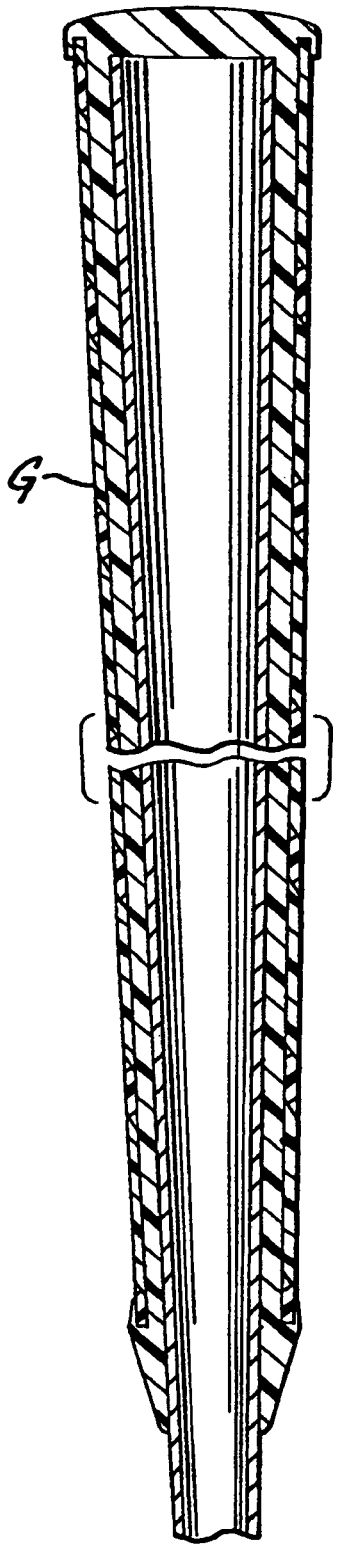
FIG. 19 is a vertical cross-sectional view of grip embodying the present invention.

Referring now to FIGS. 12–15, to secure the upper or leading edge 60 of resilient strip S within the circumferential slot 26 of cap 22, the upper edge of the strip is manually urged into the confines of the slot 26 (FIG. 13). After the upper edge of the strip S has been firmly positioned within the slot 26, the strip is spirally wrapped downwardly along the outer surface of the underlisting sleeve U (FIG. 14). When the strip S has been spirally wound to a position wherein its lower or trailing edge 62 is disposed in horizontal alignment with the lower portion of nipple groove 25 the lower end portion of the strip is manually urged into the confines of the groove by temporarily expanding the peripheral lip 70 formed outwardly of the groove so as to admit the lower edge of the strip into the groove. When the lip 70 returns to its original position, the lip will securely retain the lower end of the strip to the upper portion of the nipple as shown in FIGS. 16–18. The resulting grip G embodying the present invention is shown in FIG. 19. Referring thereto, it will be seen that the upper end of strip S is restrained against unraveling by being locked in cap slot 26 while the lower end of such strip is restrained against unraveling by nipple lip 70. The aforedescribed arrangement for securing the upper edge of the strip S is particularly useful in securely retaining a two-piece strip on the upper portion of the underlisting sleeve since the narrower strip segment has a tendency to become unraveled.

The spiral wrapping of the strip S about the underlisting U, and the positioning of the upper and lower edges of the strip within the slot 26 and groove 25 may take place when the underlisting sleeve is positioned upon a mandrel M in a conventional manner. After the strip has been secured upon the underlisting U, the sleeve and strip combination may be removed from the mandrel and slipped onto the handle portion of a golf club shaft.

It should be understood that various modifications and changes may be made with respect to the above-described embodiment without departing from the scope of the present invention. By way of example, the resilient strip may be of one-piece construction such as that shown in my aforementioned U.S. Pat. No. 6,386,989, rather than the two segment construction described hereinabove.

I claim:

1. A golf club grip assembly comprising:

a resilient underlisting sleeve formed at its upper end with a cap and at its lower end with a nipple;

a flange cooperating to define a downwardly facing circumferential slot formed on the underside of the cap when such cap is made, the cap configured and constructed such that the flange is unable to be completely flipped in a reverse direction;

an upwardly facing groove formed in the upper portion of the nipple, the outer portion of the groove being defined by a flexible circumferential lip, with the lip being expandable outwardly;

a resilient strip spirally wrapped about and adhered to the underlisting sleeve between the lower portion of the cap and the upper portion of the nipple with the upper edge of the resilient strip being inserted into the circumferential cap slot so as to be firmly locked therein; and the circumferential nipple lip being expandable outwardly to receive the lower end of the resilient strip within the groove, with the cap slot and nipple groove cooperating to thereby restrain the entire length of the strip from unraveling from the underlisting sleeve.

2. A golf club grip assembly as set forth in claim 1 wherein the resilient strip is formed of first and second individual segments having their side edges adhered-together.

3. A golf club grip assembly as set forth in claim 1 wherein the resilient strip includes an upper polyurethane layer, the underside of which is bonded to a backing layer, with the side edges of the polyurethane layer being formed with recessed reinforcement side edges and the side edges of the backing layer are skived to form outwardly and upwardly slanted side edges, with the side edges of the strip overlapping one another.

4. A golf club grip assembly as set forth in claim 3 wherein the backing layer is a felt.

5. A golf club grip assembly as set forth in claim 3 wherein the backing layer is an EVA.

6. A golf club grip assembly comprising:

a resilient underlisting sleeve formed at its upper end with a cap and at its lower end with a nipple;

a flange cooperating to define a downwardly facing circumferential slot formed on the underside of the cap when such cap is made, the cap configured and constructed such that the flange is unable to be completely flipped in a reverse direction;

a resilient strip including first and second individual segments having their side edges adhered-together, with one of such segments being embossed with depressed indicia which densifies such one of such segments so as to reduce stretching of said one of such segment, with the upper edge of the resilient strip being inserted into the cap slot so as to be firmly locked therein;

an upwardly facing groove formed in the upper portion of the nipple, the outer portion of the groove being defined by a flexible circumferential lip, with the lip being expandable outwardly to receivethe lower end of the resilient strip within the groove; and the resilient strip being spirally wrapped about and adhered to the underlisting sleeve with the cap slot and nipple groove cooperating to thereby restrain the entire length of the strip from unraveling from the underlisting sleeve and with the embossed depressed indicia increasing the hoop strength of the resilient strip.

7. A golf club grip assembly comprising:

a resilient underlisting sleeve formed at its upper end with a cap and at its lower end with a nipple;

a resilient strip having an upper polyurethane layer, the underside of which is bonded to a backing layer, the resilient strip including first and second individual segments having their side edges adhered-together, with the polyurethane layer of one of such segments being embossed with depressed indicia which densifies the polyurethane layer so as to reduce stretching of such one segment;

a flange cooperating to define a downwardly facing circumferential slot formed on the underside of the cap when such cap is made, the cap configured and constructed such that the flange is unable to be completely flipped in a reverse direction;

an upwardly facing groove formed in the upper portion of the nipple, the outer portion of the groove being defined by a flexible circumferential lip, with the lip being expandable outwardly to receive the lower end of the resilient strip within the groove; and the resilient strip being spirally wrapped about and adhered to the underlisting sleeve with the cap slot and nipple groove cooperating to thereby restrain the entire length of the strip from unraveling from the underlisting sleeve and with the embossed depressed indicia increasing the hoop strength of the resilient strip.

8. A golf club grip assembly as set forth in claim 7 wherein the backing layer is a felt.

9. A golf club grip assembly as set forth in claim 7 wherein the backing layer is an EVA.

10. A method of making a golf club grip, said method including the steps of:

providing a resilient underlisting sleeve having a cap at its upper end and a nipple at its lower end;

forming a flange cooperating to define a downwardly facing circumferential slot on the underside of the cap when such cap is made wherein the flange is unable to be completely flipped in the reverse direction;

forming an upwardly facing groove in the upper portion of the nipple, the outer portion of the groove being defined by a flexible lip;

providing a resilient strip;

inserting the upper edge of the resilient strip into the downwardly facing circumferential slot of the cap so as to lock the upper edge therein;

with the upper edge of the resilient strip being firmly locked within the downwardly facing circumferential slot to restrain the upper portion of the resilient strip from unraveling from the underlisting sleeve, spirally wrapping the strip downwardly about the underlisting sleeve;

with the upper edge of the resilient strip being firmly locked within the downwardly facing circumferential slot to restrain the upper portion of the resilient strip from unraveling from the underlisting sleeve, flexing the nipple lip outwardly to receive and then secure the lower end of the resilient strip within the groove to retain the lower portion of the strip to the lower portion of the underlisting sleeve;

with the upper edge of the resilient strip being firmly locked within the downwardly facing circumferential slot to restrain the upper portion of the resilient strip from unraveling from the underlisting sleeve, adhering the resilient strip along a length of the underlisting sleeve; and whereby the cap slot and nipple groove cooperate to restrain the entire length of the resilient strip from unraveling from the sleeve.

11. The method as set forth in claim 10 which further includes providing a collapsible mandrel and positioning the underlisting sleeve upon the mandrel as the resilient strip is spirally wrapped around and adhered to the underlisting sleeve, with the underlisting sleeve thereafter being removed from the mandrel.

12. The method as set forth in claim 10 wherein the step of providing a resilient strip includes providing a resilient strip having an upper polyurethane layer having its underside bonded to a backing layer.

13. The method as set forth in claim 12 wherein the step of providing a resilient strip includes providing a resilient strip having a backing layer which is felt.

14. A golf club grip made according to the method as set forth in claim 10.

15. The method as set forth in claim 12 wherein the step of providing a resilient strip includes providing a resilient strip having a backing layer which is EVA.

16. A method of making a golf club grip, said method including the steps of:

providing a resilient underlisting sleeve having a cap at its upper end and a nipple at its lower end;

forming a flange cooperating to define a downwardly facing circumferential slot on the underside of the cap when such cap is made wherein the flange is unable to be completely flipped in the reverse direction;

forming an upwardly facing groove in the upper portion of the nipple, the outer portion of the groove being defined by a flexible lip;

providing a resilient strip having adhered-together first and second individual segments;

embossing one of such segments with depressed indicia which densifies at said one of segments so as to reduce stretching of said one of such segments;

inserting the upper edge of the resilient strip into the downwardly facing circumferential slot of the cap;

with the upper edge of the resilient strip being firmly locked within the downwardly facing circumferential slot, spirally wrapping the strip downwardly about the underlisting sleeve;

with the upper edge of the resilient strip being firmly locked within the downwardly facing circumferential slot, flexing the nipple lip outwardly to receive and then secure the lower end of the resilient strip within the groove to retain the lower portion of the strip to the lower portion of the underlisting sleeve;

with the upper edge of the resilient strip being firmly locked within the downwardly facing circumferential slot, adhering the resilient strip along a length of the underlisting sleeve, whereby the cap slot and nipple groove cooperate to restrain the entire length of the resilient strip from unraveling from the sleeve and with the embossed depressed indicia increasing the hoop strength of the resilient strip.

17. The method as set forth in claim 16 which further includes providing a collapsible mandrel and positioning the underlisting sleeve upon the mandrel as the resilient strip is spirally wrapped around and adhered to the underlisting sleeve, with the underlisting sleeve thereafter being removed from the mandrel.

18. The method as set forth in claim 17 wherein the segments include an upper polyurethane layer having its underside bonded to a backing layer and the polyurethane layer of said one of the segments is embossed with the depressed indicia.

19. The method as set forth in claim 18 which includes the further steps of forming the outer edges of the polyurethane layer of the adhered-together segments with recessed reinforcement edges, skiving the sides of the backing layer outwardly and upwardly, and overlapping the said side edges when the resilient strip is spirally wrapped about the underlisting sleeve.

20. The method as set forth in claim 19 wherein the backing layer is a felt.

21. The method as set forth in claim 19 wherein the backing layer is an EVA.

22. The method as set forth in claim 16 wherein the segments include an upper polyurethane layer having its underside bonded to a backing layer and the polyurethane layer of said one of the segments is embossed with the depressed indicia.

23. The method as set forth in claim 22 which includes the further steps of forming the outer edges of the polyurethane layer of the adhered-together segments with recessed reinforcement edges, skiving the sides of the backing layer outwardly and upwardly, and overlapping the said side edges when the resilient strip is spirally wrapped about the underlisting sleeve.

24. A golf club grip made according to the method as set forth in claim 16.

25. A golf club grip assembly comprising:

a resilient underlisting sleeve formed at its upper end with an integral cap and at its lower end with an integral nipple;

the sleeve further includes a downwardly facing circumferential slot formed on the underside of the cap, the confines of the slot being partially defined by a flange configured and constructed such that the flange is unable to be completely flipped in a reverse direction and an upwardly facing groove formed in an upper portion of the nipple, an outer portion of the groove being defined by a flexible circumferential lip, wherein the cap slot and nipple groove are confugured to receive and retain an outer resilient layer.

26. A method of making a golf club grip, the method comprising:

forming a resilient underlisting sleeve with an integral cap at its upper end and an integral nipple at its lower end;

forming the underside of the cap with a downwardly facing circumferential slot, the confines of the slot being partially defined by a flange configured and constructed such that the flange is unable to be completely flipped in a reverse direction;

forming an upwardly facing groove in the upper portion of the nipple, an outer portion of the groove is defined by a flexible lip so that the cap slot and nipple groove are configured to receive and retain an outer resilient layer.

* * * * *